US005551228A

United States Patent [19]

Mick et al.

[11] Patent Number: 5,551,228

[45] Date of Patent: Sep. 3, 1996

[54] METHOD FOR STAGING FUEL IN A TURBINE IN THE PREMIXED OPERATING MODE

[75] Inventors: Warren J. Mick, Altamont; Mitchell R. Cohen, Troy, both of N.Y.

[73] Assignee: General Electric Co., Schenectady, N.Y.

[21] Appl. No.: 524,146

[22] Filed: Aug. 22, 1995

Related U.S. Application Data

[63] Continuation of Ser. No. 258,041, Jun. 10, 1994, abandoned.

[51] Int. Cl.[6] ..... F02C 7/264

[52] U.S. Cl. ..... 60/39.06

[58] Field of Search ..... 60/39.06, 39.02, 60/722, 737, 738, 739, 740, 746, 747, 748

[56] References Cited

U.S. PATENT DOCUMENTS

| | | | |
|---|---|---|---|
| 3,158,998 | 12/1964 | Robinson et al. | 60/739 |
| 4,027,473 | 6/1977 | Baker | 60/739 |
| 4,417,439 | 11/1983 | Sepulveda et al. | 60/746 |
| 4,499,735 | 2/1985 | Moore et al. | 60/746 |
| 4,817,389 | 4/1989 | Lolladay et al. | 60/746 |
| 5,069,029 | 12/1991 | Kuroda et al. | 60/39.06 |
| 5,121,597 | 6/1992 | Urushidani et al. | 60/733 |
| 5,259,184 | 11/1993 | Borkowicz et al. | 60/737 |

*Primary Examiner*—Timothy S. Thorpe
*Attorney, Agent, or Firm*—Nixon & Vanderhye

[57] ABSTRACT

A method of operating a combustor for a turbine in the premixed mode includes flowing fuel through a symmetrical annular array of fuel nozzles to provide an asymmetrical fuel pattern across the combustor. Each nozzle includes an air swirler and the fuel is injected at axially spaced locations on opposite sides of the swirler. The asymmetrical fuel flow is provided during a diffusion mode of operation prior to transition between the diffusion mode and also during the transition. Near full power, the fuel is supplied equally among the fuel nozzles operating in the premixed mode. The asymmetric fuel flow stabilizes the combustor and inhibits high amplitude combustion noise and the axial staging of the fuel achieves low emission operation in the premixed mode.

20 Claims, 5 Drawing Sheets

METHOD FOR STAGING FUEL IN A TURBINE IN THE PREMIXED OPERATING MODE

This is a continuation of application Ser. No. 08/258,041 filed on Jun. 10, 1994 now abandoned.

TECHNICAL FIELD

The present invention relates to gas and liquid fueled turbines and more particularly to methods of operating combustors having multiple nozzles for use in the turbines when the nozzles are in the premixed mode of operation.

BACKGROUND

Turbines generally include a compressor section, one or more combustors, a fuel injection system and a turbine section. Typically, the compressor section pressurizes inlet air, which is then turned in a direction or reverse-flowed to the combustors, where it is used to cool the combustor and also to provide air for the combustion process. In a multi-combustor turbine, the combustors are generally located in an annular array about the turbine and a transition duct connects the outlet end of each combustor with the inlet end of the turbine section to deliver the hot products of the combustion process to the turbine.

There have been many developments in the design of combustors as a result of continuing efforts to reduce emissions, for example, $NO_x$ and CO emissions. Dual-stage combustors have been designed in the past, for example, see U.S. Pat. Nos. 4,292,801 and 4,982,570. Additionally, in U.S. Pat. No. 5,259,184, of common assignee herewith, there is disclosed a single-stage, i.e., single combustion chamber or burning zone, dual-mode (diffusion and premixed) combustor which operates in a diffusion mode at low turbine loads and in a premixed mode at high turbine loads. In that combustor, the nozzles are arranged in an annular array about the axis of the combustor and each nozzle includes a diffusion fuel section or tube so that diffusion fuel is supplied to the burning zone downstream of the nozzle and a dedicated premixing section or tube so that in the premixed mode, fuel is premixed with air prior to burning in the single combustion zone. More specifically, and in that patent, there is described diffusion/premixed fuel nozzles arranged in a circular array mounted in a combustor end cover assembly and concentric annular passages within the nozzle for supplying fuel to the nozzle tip and swirlers upstream of the tip for respective flow of fuel in diffusion and premixed modes.

It has been discovered, however, that during the transition from the diffusion mode to the premixed mode, the combustor displays a tendency to become unstable and generates high amplitude combustion noise. Additionally, as air flow and fuel flow are varied to the combustor as required by the turbine's operating cycle, the combustor's stability and noise level can be adversely affected. The consequence of a combustor with insufficient stability is the limited turndown of the combustor. The consequences of a combustor with unacceptably high noise levels are premature wear or high cycle fatigue cracking of structural components in the combustor. To design a dry low $NO_x$ combustor, it will be appreciated that $NO_x$ emissions, CO emissions, combustion dynamics and combustion stability are factors which must be considered from an aerodynamic standpoint. The nature of the combustion process provides an interdependency of these factors.

In the combustor design disclosed in U.S. Pat. No. 5,259,184, previously discussed, fuel transfer from diffusion mode to premixed mode is effected simultaneously. That is, the fuel is transferred from all diffusion nozzles simultaneously to all premixed nozzles. To accomplish that, the fuel transfer is made by simply redirecting fuel from the diffusion supply manifold to the premixed supply manifold. While the fuel nozzle end cover was internally manifolded with a fuel supply flange feeding an internal manifold for four of five premix nozzles and a fuel supply flange feeding an internal manifold for the fifth premix nozzle, the manifold arrangement was provided only in order to cope with a generator trip event while operating in a premixed mode. All premix nozzles were intended to flow equal rates of fuel into the combustor. Thus, combustion stability and combustion dynamics created certain difficulties in using this single-stage type combustor, particularly during transition from the diffusion mode to the premixed mode.

In an effort to cure these problems, as described in a companion application Ser. No. 08/258,112, now U.S. Pat. No. 5,551,228, the supply of fuel during transition from the diffusion mode to the premixed mode is staged, as well as during steady-state operation in the premixed mode. That is, the control of the flow of fuel through the nozzles is varied to provide an asymmetric flow of fuel across the combustor during the transition from diffusion mode of operation to premixed mode of operation and during portions of the premixed mode of operation. In that invention, at the start of transition, one of the five premixed nozzles is actuated to flow premixed fuel to the single combustion zone, while the remaining four nozzles continue operation in a diffusion mode. Thus, the percentage of total fuel supplied the combustion zone by the fifth nozzle is greater than the percentage of total fuel supplied by any one of the diffusion nozzles, thus affording an asymmetrical fuel loading across the combustor. At higher loadings, fuel from the diffusion manifold is shut down and fuel is supplied to the four remaining premixed nozzles from the premix manifold. During this transition, the fifth nozzle also has a higher fuel/air ratio than any one of the remaining four premixed nozzles. Hence, the fifth nozzle runs rich and stable and stabilizes the remaining four nozzles. At full load, the fuel split among the various nozzles in the premix mode is equal. Thus, by unequally fueling the nozzles during transition and during premix operation below full load, severe combustion dynamics, i.e., high acoustical noise and resonation, is inhibited as a result of the imbalance of fuel across the combustor.

However, it has also been discovered that by varying the fuel/air ratio among the nozzles across the combustor, there is a tendency to increase $NO_x$ and CO emissions. It will be appreciated that in an annular array of nozzles about the axis of the combustor, the lowest emission levels are obtained when all of the premixed nozzles are supplied with equal, or very close to equal, amounts of fuel, with each nozzle being provided a percentage of the total fuel corresponding to the percentage of the one nozzle to the total number of nozzles. The decreases in dynamic pressure levels achieved by generating unequal fueling of the nozzles across the combustor have been found to be offset by increases in $NO_x$ and/or CO emissions over various parts of the load range. Thus, while the asymmetrical fueling of the nozzles across the combustor generates lower dynamic pressure levels, it does so at the expense of increased emissions in the premixed operating mode.

DISCLOSURE OF THE INVENTION

In accordance with the present invention, and in addition to the asymmetrical staging of the fuel across the combustor, the fuel is also axially staged to achieve lower dynamic pressure levels without adversely impacting emissions performance and without reducing the operating range of the combustor by reducing the flame stability. To accomplish this, the asymmetrical fueling set forth in the companion application is maintained. In addition, a portion of the total fuel is supplied to some or all of the nozzles at a location upstream of the swirler during the premixed mode of operation. This redistribution of the fuel is accomplished without varying total fuel flow through the combustor. For example, the axial upstream fuel injection may be accomplished by providing a plurality of radial pegs extending off each of the nozzles on the upstream side of the swirler. Alternatively, the fuel can be injected from pegs extending off the nozzle end cover into the forward casing plenum or from pegs that are fed through the casing outer wall.

The amount of upstream fuel may be a fixed or variable percentage of the total fuel. By feeding the upstream fuel through a separate manifold, its percentage of total fuel may be varied through use of a separate control valve. If it shares a common manifold with the four premix nozzles and/or the one premix nozzle, its fuel flow will be a fixed percentage of the fuel flow in those manifolds. The percentage is fixed by setting the appropriate effective area of the upstream fuel injection pegs relative to the downstream fuel injection pegs on the common manifold. Both options enable independent control of total fuel split between the four premixer nozzles and the one premixer nozzle. Additionally, the upstream fuel may be fed evenly to all five nozzles or may be split unevenly between the one and the four premix nozzles. In either case, the split of total fuel between the one and the four premix nozzles can still be separately controlled by simultaneously adjusting the split of fuel fed through the downstream pegs.

In a preferred embodiment according to the present invention, there is provided a method of operating a combustor for a gas turbine comprising the steps of flowing fuel into the combustor at axially spaced locations along the combustor and variably controlling the flow of fuel to a downstream combustion zone to provide an asymmetric flow of fuel across the combustor during the premixed operating mode.

In a further preferred embodiment according to the present invention, there is provided a method of operating a combustor for a gas turbine in a premixed operating mode, the combustor having a plurality of fuel nozzles in an annular array about the combustor and a swirler about each nozzle for swirling air passing through the combustor, comprising the steps of flowing fuel into a combustion zone downstream of the nozzles, at axially spaced locations along the combustor, and from opposite axial sides of the swirler, and providing an asymmetric flow of fuel across the combustor to the combustion zone.

In a still further preferred embodiment according to the present invention, there is provided a method of operating a combustor for a gas turbine in the premixed mode wherein the combustor has a plurality of nozzles comprising the step of flowing fuel through at least certain of the plurality of nozzles and into the combustor at axial spaced locations along the combustor.

Accordingly, it is a primary object of the present invention to provide in combustors for turbines a method of staging fuel to the fuel nozzles of the combustor for quiet and stable operation in the premixed mode of operation over a wider load range of the turbine and without adverse effect on emissions.

BEST MODE FOR CARRYING OUT THE INVENTION

Figure 1:
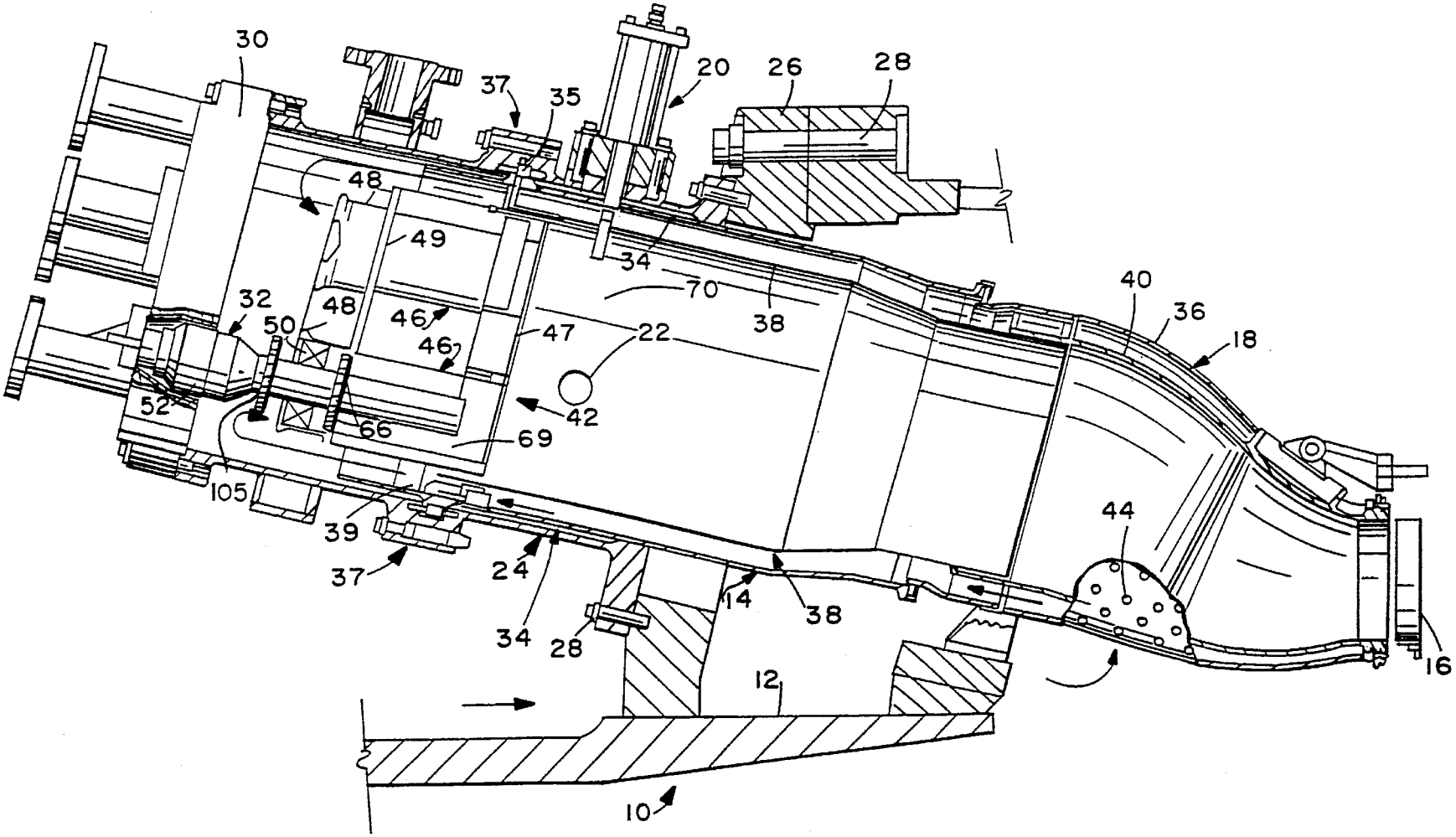
FIG. 1 is a cross-sectional view through one of the combustors of a turbine in accordance with an exemplary embodiment of the present invention.

With reference to FIG. 1, the gas turbine 10 includes a compressor 12 (partially shown), a plurality of combustors 14 (one shown), and a turbine represented here by a single blade 16. Although not specifically shown, the turbine is drivingly connected to the compressor 12 along a common axis. The compressor 12 pressurizes inlet air which is then reverse flowed to the combustor 14 where it is used to cool the combustor and to provide air to the combustion process.

As noted above, the gas turbine includes a plurality of combustors 14 located about the periphery of the gas turbine. A double-walled transition duct 18 connects the outlet end of each combustor with the inlet end of the turbine to deliver the hot products of combustion to the turbine. Ignition is achieved in the various combustors 14 by means of spark plug 20 in conjunction with cross fire tubes 22 (one shown) in the usual manner.

Each combustor 14 includes a substantially cylindrical combustion casing 24 which is secured at an open forward end to the turbine casing 26 by means of bolts 28. The rearward end of the combustion casing is closed by an end cover assembly 30 which includes conventional supply tubes, manifolds and associated valves, etc., for feeding gas, liquid fuel and air (and water if desired) to the combustor as described in greater detail below. The end cover assembly 30 receives a plurality (for example, five) of fuel nozzle assemblies 32 (only one shown for purposes of convenience and clarity) arranged in a symmetric circular array about a longitudinal axis of the combustor (see FIG. 5).

Within the combustor casing 24, there is mounted, in substantially concentric relation thereto, a substantially cylindrical flow sleeve 34 which connects at its forward end to the outer wall 36 of the double-walled transition duct 18. The flow sleeve 34 is connected at its rearward end by means of a radial flange 35 to the combustor casing 24 at a butt joint 37 where fore and aft sections of the combustor casing 24 are joined.

Within the flow sleeve 34, there is a concentrically arranged combustion liner 38 which is connected at its forward end with the inner wall 40 of the transition duct 18. The rearward end of the combustion liner 38 is supported by a combustion liner cap assembly 42 which is, in turn, supported within the combustor casing by a plurality of struts 39 and associated mounting flange assembly 41 (best seen in FIG. 5). It will be appreciated that the outer wall 36 of the transition duct 18, as well as that portion of flow sleeve 34 extending forward of the location where the combustion casing 24 is bolted to the turbine casing (by bolts 28), are formed with an array of apertures 44 over their respective peripheral surfaces to permit air to reverse flow from the compressor 12 through the apertures 44 into the annular space between the flow sleeve 34 and the liner 38 toward the upstream or rearward end of the combustor (as indicated by the flow arrows shown in FIG. 1).

Figure 5:
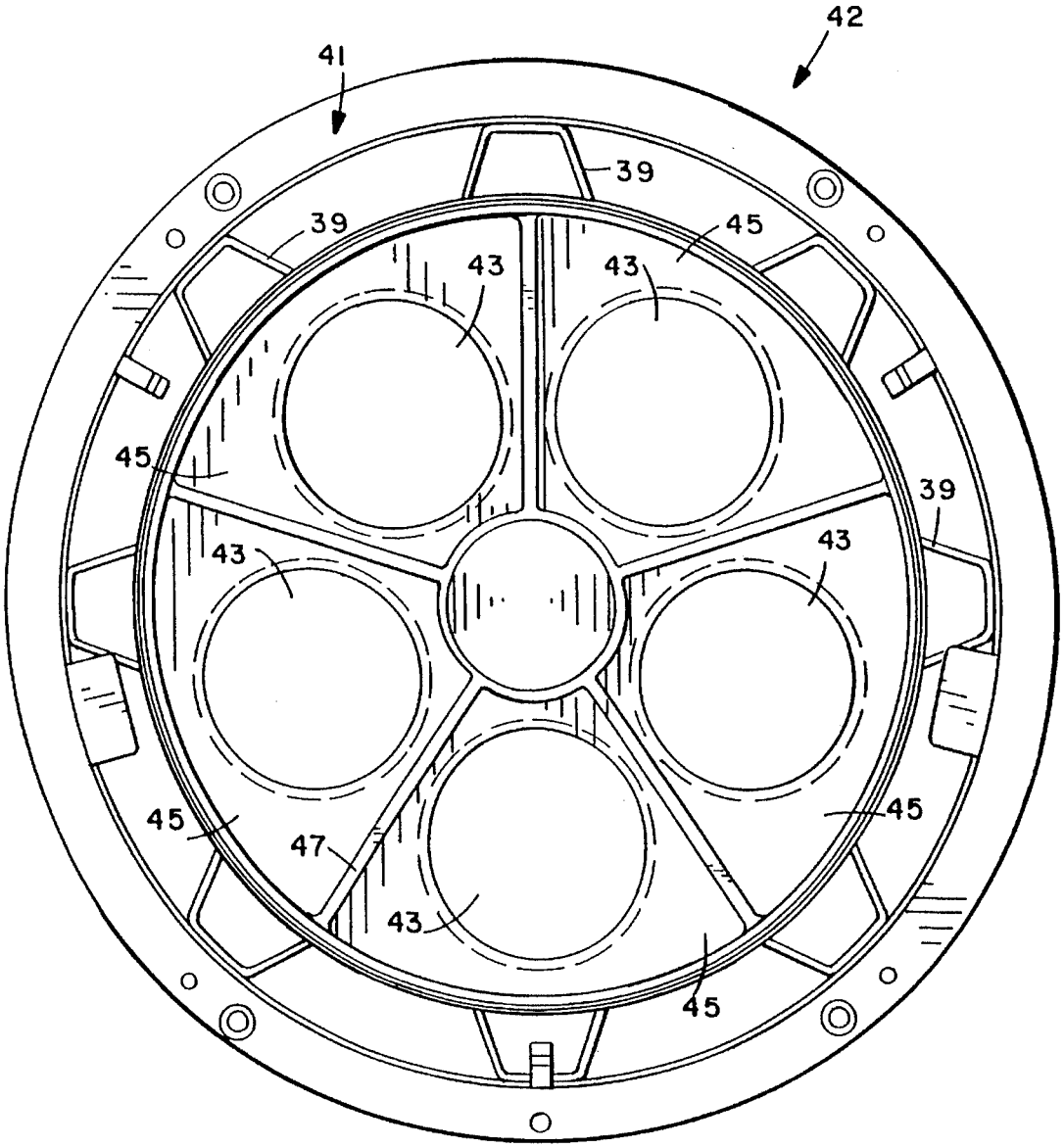
FIG. 5 is a front end view of the combustion liner cap assembly.

The combustion liner cap assembly 42 supports a plurality of premix tubes 46, one for each fuel nozzle assembly 32. More specifically, each premix tube 46 is supported within the combustion liner cap assembly 42 at its forward and rearward ends by front and rear plates 47, 49, respectively, each provided with openings aligned with the open-ended premix tubes 46. This arrangement is best seen in FIG. 5, with openings 43 shown in the front plate 47. The front plate 47 (an impingement plate provided with an array of cooling apertures) may be shielded from the thermal radiation of the combustor flame by shield plates 45.

The rear plate 49 mounts a plurality of rearwardly extending floating collars 48 (one for each premix tube 46, arranged in substantial alignment with the openings in the rear plate), each of which supports an air swirler 50 in surrounding relation to a radially outermost tube of the nozzle assembly 32. The arrangement is such that air flowing in the annular space between the liner 38 and flow sleeve 34 is forced to again reverse direction in the rearward end of the combustor (between the end cap assembly 30 and sleeve cap assembly 44) and to flow through the swirlers 50 and premix tubes 46 before entering the burning zone within the liner 38, downstream of the premix tubes 46.

Figure 2:
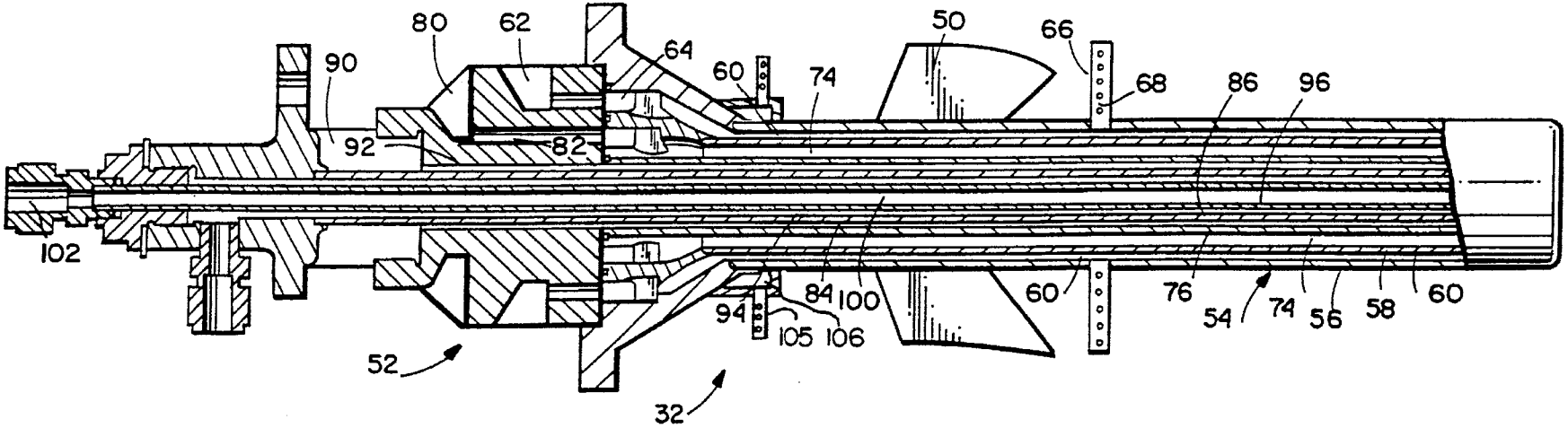
FIG. 2 is a sectional view of a fuel injection nozzle thereof.
Figure 3:
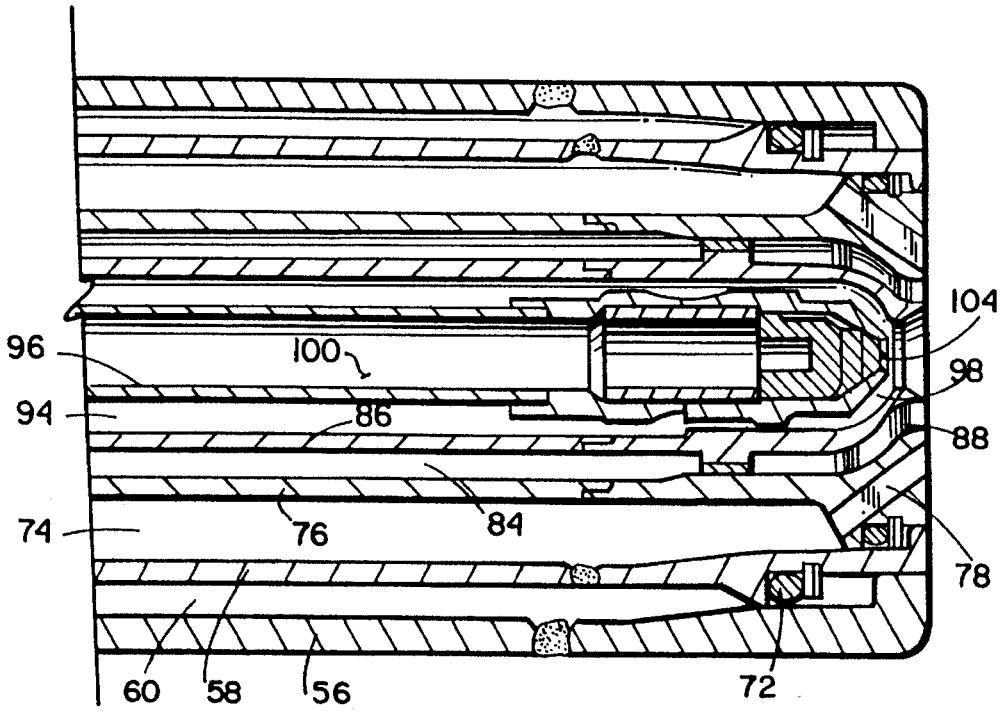
FIG. 3 is an enlarged end detail of the forward end of the nozzle.
Figure 4:
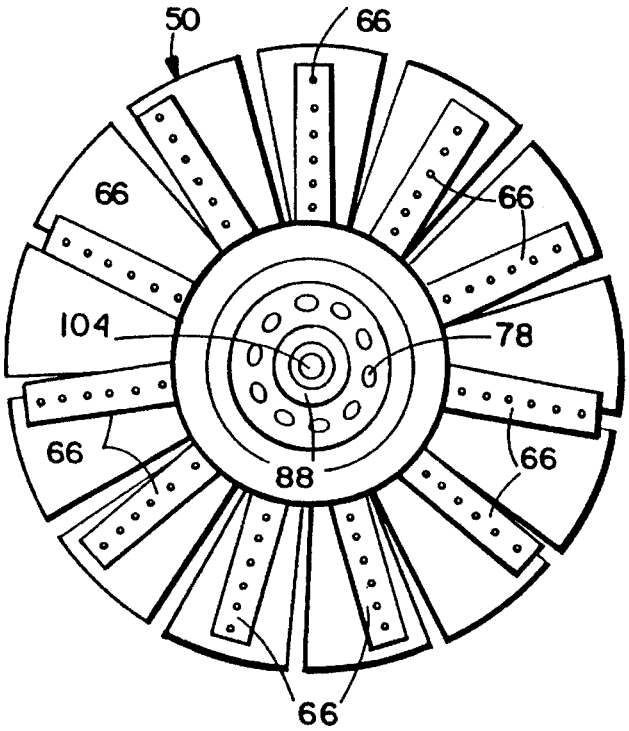
FIG. 4 is a front end view of a nozzle.

Turning to FIGS. 2, 3 and 4, each fuel nozzle assembly 32 includes a rearward supply section 52 with inlets for receiving liquid fuel, atomizing air, diffusion gas fuel and premix gas fuel, and with suitable connecting passages for supplying each of the above mentioned fluids to a respective passage in a forward delivery section 54 of the fuel nozzle assembly, as described below.

The forward delivery section 54 of the fuel nozzle assembly is comprised of a series of concentric tubes 56, 58. The tubes 56 and 58 provide a premix gas passage 60 which receives premix gas fuel from an inlet 62 connected to passage 60 by means of conduit 64. The premix gas passage 60 also communicates with a plurality (for example, eleven) radial fuel injectors (pegs) 66, each of which is provided with a plurality of fuel injection ports or holes 68 for discharging gas fuel into a premix zone 69 located within the premix tube 46. The injected fuel mixes with air reverse flowed from the compressor 12, and swirled by means of the annular swirler 50 surrounding the fuel nozzle assembly upstream of the radial injectors 66.

The premix passage 60 is sealed by an O-ring 72 at the forward or discharge end of the fuel nozzle assembly, so that premix fuel may exit only via the radial fuel injectors 66.

The next adjacent passage 74 is formed between concentric tubes 58 and 76, and supplies diffusion gas to the burning zone 70 of the combustor via orifice 78 at the forwardmost end of the fuel nozzle assembly 32. The forwardmost or discharge end of the nozzle is located within the premix tube 46, but relatively close to the forward end thereof. The diffusion gas passage 74 receives diffusion gas from an inlet 80 via conduit 82.

A third passage 84 is defined between concentric tubes 76 and 86 and supplies atomizing air to the burning zone 70 of the combustor via orifice 88 where it then mixes with diffusion fuel exiting the orifice 78. The atomizing air is supplied to passage 84 from an inlet 90 via conduit 92.

The fuel nozzle assembly 32 is also provided with a further passage 94 for (optionally) supplying water to the burning zone to effect $NO_x$ reductions in a manner understood by those skilled in the art. The water passage 94 is defined between the tube 86 and adjacent concentric tube 96. Water exits the nozzle via an orifice 98, radially inward of the atomizing air orifice 88.

Tube 96, the innermost of the series of concentric tubes forming the fuel injector nozzle, itself forms a central passage 100 for liquid fuel which enters the passage by means of inlet 102. The liquid fuel exits the nozzle by means of a discharge orifice 104 in the center of the nozzle. It will be understood by those skilled in the art that the liquid fuel capability is provided as a back-up system, and passage 100 is normally purged with compressor discharge air while the turbine is in its normal gas fuel mode.

Referring now to FIGS. 1 and 2, and in accordance with the present invention, there are provided a plurality of circumferentially spaced, radially extending fuel injector pegs 105 upstream of the swirlers 50 for each nozzle. As illustrated in FIG. 2, the pegs 105 lie in communication with a manifold 106 about the outer tube 56 of each nozzle. Consequently, premix fuel is supplied to manifold 106 for injection into the reverse flow of air from the compressor for flow with the air through the swirler and past the downstream injectors 66. Thus, there are two axial locations for injection of the premixed fuel, i.e., upstream and downstream of the swirlers 50.

To summarize the operation of the nozzle thus far described, diffusion gas fuel is fed through inlet 80, conduit 82 and passage 74 for discharge via orifice 78 into the burning zone 70, where it mixes with atomizing air, is ignited by sparkplug 20 and burned in the zone 70 within the liner 38 during a diffusion mode of operation. At higher loads, premix gas fuel is supplied to the passages 60 via inlet 62 and conduit 64 for discharge through orifices 68 in downstream radial injectors 66. The premix fuel mixes with air, entering the premix tube 46 by means of swirlers 50, the mixture igniting in burning zone 70 in liner 38 by the preexisting flame from the diffusion mode of operation. Hence, there is a single burning zone 70 for burning the fuel in both the premix and diffusion modes of operation. During premix operation, the fuel to the diffusion passage 74 is shut down, but, during premixed operation, premix fuel is supplied to the manifold 106 for flow through the radially projecting pegs 105 upstream of the swirlers 50. Thus, the fuel flow through radial pegs 105 into the airstream from the compressor flows past the swirlers 50 and is combined with the premix fuel injected into the airstream via pegs 66. Consequently, pegs 66 and 105 stage the fuel flow into the combustor at different axial locations.

As indicated previously, certain tendencies toward instability and high amplitude combustion noise are exhibited during the premixed mode of operation. The present invention stages the fuel to the fuel nozzles in a manner which will now be described to minimize or eliminate those tendencies, as well as to enable operation in a premixed mode over a wider load range of the turbine than previously believed possible and without adversely impacting emissions.

Figure 6:
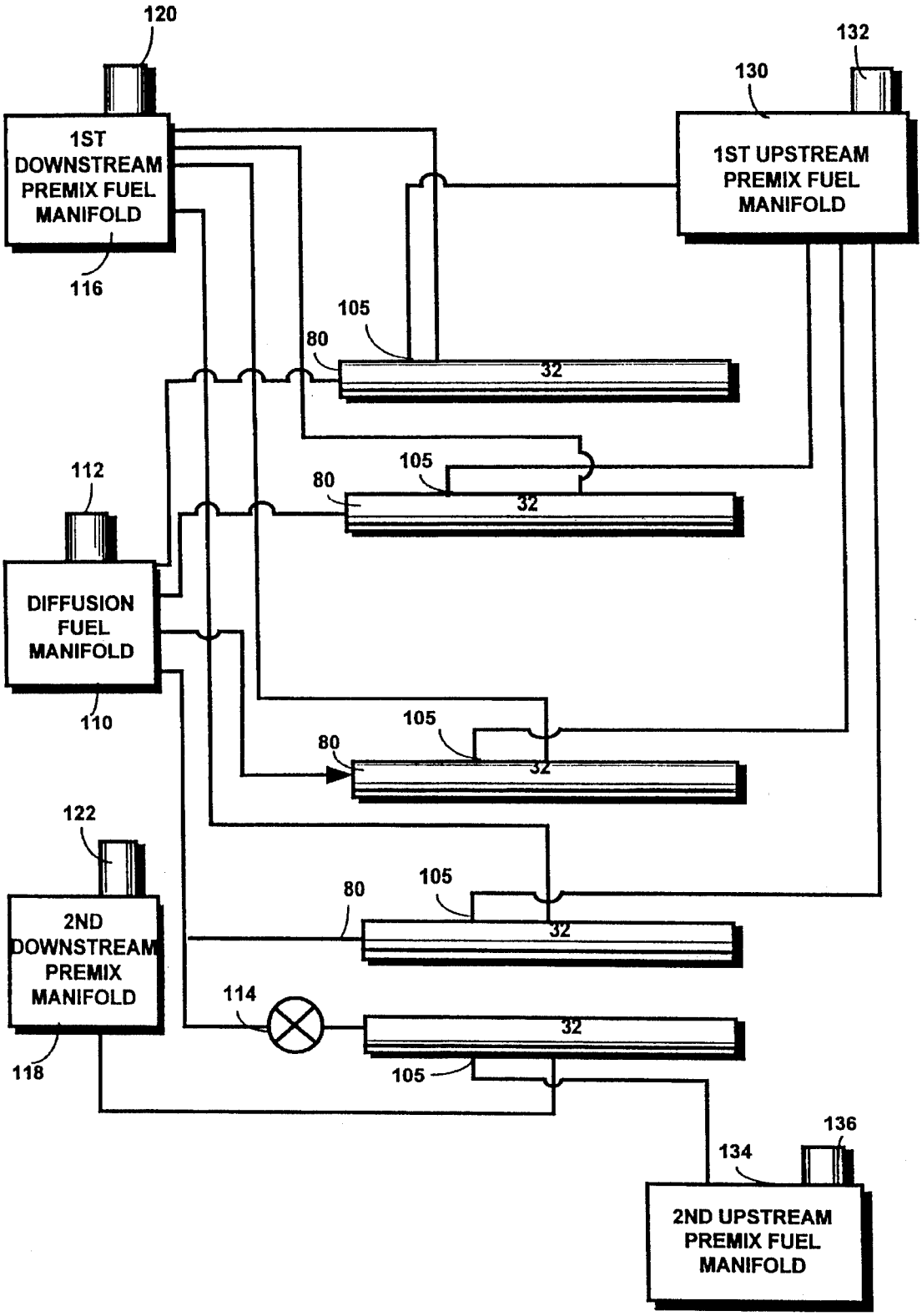
FIG. 6 is a schematic illustration of the arrangement of the nozzles with the premix and diffusion fuel supply manifolds.

Referring now to FIG. 6, there is schematically represented a diffusion fuel manifold 110 for supplying diffusion fuel to the diffusion fuel inlet passages 80 of the various nozzles 32. A valve 112 may be located in the manifold 110 to open and close the supply of fuel from manifold 110 to the nozzles. Additionally, a valve 114 may be disposed in the diffusion fuel line to one or more of the diffusion fuel nozzles. Further, in FIG. 6, there is illustrated a first downstream premix manifold 116 for supplying premix fuel to certain of the nozzles and a second downstream premix manifold 118 for supplying fuel to the remaining one or more nozzles. The first and second downstream premix manifolds have valves 120 and 122, respectively, movable between open and closed positions to supply fuel or not to the connected nozzles. Individual valves can be located in the individual supply lines as desirable and it will be appreciated that the manifold valves, as well as any valves disposed in the fuel supply lines, will be operated in a conventional manner. A first upstream premix fuel manifold 130 is provided for supplying premix fuel to each of the four nozzles by way of the manifolds 106 about those nozzles. The first upstream premix manifold 130 is under the control of a valve 132 to open and close the supply of fuel from manifold 130 to the nozzles. A second upstream premix fuel manifold 134 is provided for supplying premix fuel to the fifth premix nozzle via manifold 106 about that nozzle. A valve 136 is located in manifold 134 to open and close the supply of fuel from the manifold 134 to the fifth nozzle.

To stage the fuel during the operation of the combustor, at start-up, the valve 112 is opened to supply diffusion fuel from manifold 110 to each of the nozzles 32 or to a lesser number of the nozzles, for example, by closing valve 114, or by omitting a diffusion fuel supply line entirely to one or more of the nozzles. With the turbine combustor now operating in the diffusion mode with all or less than all of the nozzles supplied with the diffusion fuel, load is applied to the turbine. In one preferred form of operation, the diffusion fuel is supplied only to four of the five nozzles, as illustrated, and the fifth nozzle is totally disconnected from the diffusion fuel manifold and supplies only air to the fifth nozzle during start-up. As load is applied, for example, within a range of 30 to 50% of full power, the combustor is transitioned from operation in a diffusion mode to operation in a premixed mode in the manner set forth in companion application Ser. No. 08/258,112.

Once operation in the premixed mode is established, modulation of some fuel from the first downstream premix manifold 116 to the first upstream premix manifold 130, and from the second downstream premix manifold 118 to the second upstream premix manifold 134, is begun by appropriate positioning of valves 120, 132, 122 and 136, respectively. In the preferred embodiment, first and second upstream premix manifolds 130, 134, respectively, would be combined into a single premix manifold feeding all five nozzles 32 symmetrically and simultaneously.

Further, near full load, i.e., 90%, the fuel split between the premix nozzles is modulated to provide substantially equal fuel flow to the premix nozzles, although the proportion of the fuel flow through the upstream premix injectors 105 is much less than the proportion of total fuel flow to the downstream injectors 66. Thus, the ability to vary the fuel split across the combustor enables utilization of premix nozzles designed for low $NO_x$ and CO emissions performance and which exhibit desirable stability and combustion dynamics characteristics.

It will appreciated that in the foregoing described operation, the supply of fuel to the upstream injectors tracks the supply of fuel to the downstream injectors by using a similar system for each set of axially spaced injectors. Obviously, a common manifold for the four upstream premix nozzles and the one upstream premix nozzle could be utilized whereby the fuel flow would be a fixed percentage of the fuel flow to the downstream manifolds. The percentage is fixed by setting the appropriate effective area of the upstream fuel injection pegs relative to the downstream fuel injection pegs on the common manifold, instead of varying fuel flow by means of valves. In the above-described arrangement with separate upstream fuel manifolds, the upstream fuel may be fixed or a variable percentage of total fuel. Alternatively, the upstream fuel may be fed evenly to all five nozzles or may be split unevenly between the one and the four premix nozzles. In either case, the split of total fuel between the one and the four nozzles can still be separately controlled by simultaneously adjusting the split of fuel fed through the downstream pegs. In a further alternative, the upstream premix fuel can be distributed equally to all five nozzles through a single manifold. Thus, the single manifold would supply fuel to the manifold 106 surrounding each nozzle and may have an independently controlled fuel supply so that the ratio of upstream fuel to total fuel is variable. Thus, as upstream fuel flow is increased, the downstream fuel flow to the one and the four nozzles can be cut back in equal proportions to maintain a constant fuel split between the one and the four premix nozzles.

While applicants do not intend to be limited by a theory of operation, a discussion of the theory behind the axial staging of the fuel assists to explain the reductions in dynamic pressure levels without adverse impact on emissions. Once the combustor is in a low emissions mode, and assuming all fuel in the premix mode is supplied by injectors at a common axial plane, dynamic pressure oscillations travel upstream from the flame zone. When these acoustic oscillations traverse the plane of the primary fuel injection pegs at the one axial location, it creates a pulse which modulates fuel and air flow, creating a disturbance downstream in the flame zone. More particularly, that perturbation at the primary fuel injection pegs convects downstream and this can create a wave of high or low fuel/air fluctuation into the flame zone. By providing an additional axial plane for premix fuel injection upstream of the downstream fuel injection plane, the pressure oscillations are attenuated by interference between the pressure oscillation waves.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of operating a single-stage combustor for a gas turbine wherein the combustor has an axis, a plurality of generally axially extending nozzles about said combustor axis each defining a discrete air stream, and a single zone of combustion, comprising the steps of:

operating the single-stage combustor in a premixed mode; and flowing fuel through said nozzles into said air streams, respectively, at axially spaced locations along the nozzles during the premixed mode of operation for combustion in the single zone of combustion.

2. A method according to claim 1 including varying the proportion of fuel flowing into the combustor at each of said axially spaced locations during the premixed mode of operation.

3. A method according to claim 1 including the step of variably controlling the flow of fuel to provide an asymmetric flow of fuel across the combustor.

4. A method according to claim 3 including the further steps of operating the single-stage combustor in a diffusion flow mode and in a transition mode between the diffusion flow mode and the premixed mode, and providing the asymmetric flow of fuel during the transition mode.

5. A method according to claim 3 wherein the combustor includes nozzles arranged in a symmetrical annular array about the axis of the combustor, and including the further step of providing the asymmetric flow of fuel by supplying a greater percentage of the total fuel flow through the combustor through one of said nozzles than any other of said nozzles.

6. A method according to claim 5 including varying the proportion of fuel flowing at each of said axially spaced locations during the premixed mode of operation.

7. A method according to claim 1 including suppressing combustion-generated dynamic pressure oscillations by flowing the fuel into the combustor at axially spaced locations during the premixed mode of operation.

8. A method of operating a single-stage combustor for a gas turbine, the combustor having a plurality of fuel nozzles in an annular array about an axis of the combustor, a swirler about each nozzle for swirling air passing through the combustor, and a single zone of combustion downstream of said nozzles, comprising the steps of operating the single-stage combustor in a premixed mode and flowing fuel from different locations axially spaced from one another with respect to said combustor axis and on respective opposite sides of said swirler during the premixed mode of operation and into said single combustion zone downstream of the nozzles.

9. A method according to claim 8 including varying the split of fuel flowing from the opposite sides of the swirler during the premixed mode of operation.

10. A method according to claim 8 including the step of providing an asymmetric flow of fuel across the combustor to the combustion zone.

11. A method according to claim 11 including the further steps of operating the combustor in a diffusion mode, and providing the asymmetric flow of fuel during transition between the diffusion mode of operation and the premixed mode of operation.

12. A method according to claim 10 including the further steps of operating the combustor in a transition mode between the diffusion mode of operation and the premixed mode of operation, and providing the asymmetric flow of fuel during both the transition mode of operation and the premixed mode of operation.

13. A method according to claim 8 including suppressing combustion-generated dynamic pressure oscillations by flowing the fuel into the combustor from opposite axial sides of said swirler during the premixed mode of operation.

14. A method of operating a single-stage combustor for a gas turbine wherein the combustor has a plurality of nozzles defining respective discrete air streams and a single combustion zone, comprising the steps of:

operating the combustor in a diffusion mode, a premixed mode and a transition mode between the diffusion mode of operation and the premixed mode of operation;

flowing fuel through at least certain of said plurality of nozzles operating in the diffusion mode to the single combustion zone downstream of said nozzles for combustion therein;

during operation in the transition mode, flowing fuel to the single combustion zone for combustion therein through at least one of said plurality of nozzles operating in a premixed mode while maintaining said certain nozzles operating in the diffusion mode; and flowing fuel into the combustor through said nozzles into said discrete air streams thereof, respectively, at axially spaced locations along the nozzles during the premixed mode of operation and into the single combustion zone for combustion therein to suppress dynamic pressure oscillations generated in said single combustion zone.

15. A method according to claim 14 including varying the proportion of fuel flowing at each of said axially spaced locations during the premixed mode of operation.

16. A method according to claim 14 wherein said nozzles are in an annular array about an axis of said combustor, and including the step of variably controlling the flow of fuel through said nozzles to provide an asymmetric flow of fuel across the combustor to the single combustion zone downstream of said nozzles, providing swirlers upstream of the single combustion zone for swirling air flowing through the combustor and injecting fuel into the combustor at axial locations upstream and downstream of said swirlers, respectively.

17. A method according to claim 16 including the step of providing the asymmetric flow of fuel during operation in the transition mode.

18. A method according to claim 14 including the step of, subsequent to operating in the transition mode, operating all nozzles in the premixed mode.

19. A method according to claim 14 wherein said nozzles are in an annular array about an axis of said combustor and including the further steps of, subsequent to operating in said transition mode, operating all nozzles in the premixed mode, and variably controlling the flow of fuel through said nozzles to provide an asymmetric flow of fuel across the combustor during operation of the nozzles in the premixed mode.

20. A method according to claim 14 including flowing fuel through said nozzles to provide a fuel/air ratio through one nozzle different from a fuel/air ratio through another of said nozzles.

* * * * *